US006646216B2

(12) United States Patent
Fanta et al.

(10) Patent No.: US 6,646,216 B2
(45) Date of Patent: Nov. 11, 2003

(54) OPERATING MECHANISM WITH IMPROVED INPUT DRIVE ARRANGEMENT FOR SWITCHES AND CIRCUIT INTERRUPTERS

(75) Inventors: Thomas O. Fanta, Lake Zurich, IL (US); Robert H. Ward, Jr., Mundelein, IL (US)

(73) Assignee: S&C Electric Co., Chicago, IL (US)

( * ) Notice: Subject to any disclaimer, the term of this patent is extended or adjusted under 35 U.S.C. 154(b) by 3 days.

(21) Appl. No.: 09/955,322

(22) Filed: Sep. 19, 2001

(65) Prior Publication Data

US 2002/0088699 A1 Jul. 11, 2002

Related U.S. Application Data

(60) Provisional application No. 60/239,311, filed on Oct. 10, 2000.

(51) Int. Cl.[7] ..... H01H 3/40

(52) U.S. Cl. ..... 200/400

(58) Field of Search ..... 200/400, 501; 74/625

(56) References Cited

U.S. PATENT DOCUMENTS

| | | | | |
|---|---|---|---|---|
| 4,146,764 A | | 3/1979 | Wilson | 200/400 |
| 4,596,310 A | * | 6/1986 | Hatakeyama et al. | 200/400 X |
| 5,895,987 A | * | 4/1999 | Lo et al. | 307/125 |

* cited by examiner

*Primary Examiner*—Renee Luebke
(74) *Attorney, Agent, or Firm*—James V. Lapacek

(57) ABSTRACT

A compact operating mechanism for switches and circuit interrupters provides improved input drive arrangement and more particularly to a quick-make quick-break operating mechanism for electrical circuit interrupters, i.e. load-interrupter switches and fault interrupters, the drive input arrangement being capable of either power or manual operation without the necessity of any coupling/decoupling or mode selection.

10 Claims, 5 Drawing Sheets

OPERATING MECHANISM WITH IMPROVED INPUT DRIVE ARRANGEMENT FOR SWITCHES AND CIRCUIT INTERRUPTERS

This application claims the benefit of U.S. Provisional Application No. 60/239,311 filed on Oct. 10, 2000 in the names of T. O. Fanta et al.

BACKGROUND OF THE INVENTION

1. Field of the Invention

The present invention relates generally to a compact operating mechanism for switches and circuit interrupters with improved input drive arrangement and more particularly to a quick-make quick-break operating mechanism for electrical circuit interrupters, i.e. load-interrupter switches and fault interrupters, the drive input arrangement being capable of either power or manual operation without the necessity of any coupling/decoupling or mode selection.

2. Description of Related Art

Various operating mechanisms for electrical switches and circuit interrupters provide multiple operational states at an output corresponding to the desired operational states of the switch controlled by the mechanism. For example, U.S. Pat. Nos. 5,895,987 and 6,025,657 are directed to a power operator capable of manual or power operation without decoupling. Additionally, U.S. Pat. No. 4,146,764 is directed to a spring-operated closing mechanism for a circuit breaker that does not require coupling/decoupling, the arrangement including side-by-side ratchet control plates with multiple rods passing therethrough that function as pawls. A separate opening spring is utilized for the opening function. Considering other operating mechanisms, U.S. Pat. No. 3,563,102 discloses a quick-make quick-break mechanism for operating a switch between open and closed positions. Other operating mechanisms are shown in the following U.S. Pat. Nos. 3,845,433; 4,293,834; 5,140,117; and 5,224,590.

SUMMARY OF THE INVENTION

Accordingly, it is a principal object of the present invention to provide a compact operating mechanism for switches and circuit interrupters with improved input drive arrangement and more particularly to a quick-make quick-break operating mechanism for electrical circuit interrupters, i.e. load-interrupter switches and fault interrupters, the drive input arrangement being capable of either power or manual operation without the necessity of any coupling/decoupling or mode selection.

It is another object of the present invention to provide a compact operating mechanism that incorporates manual and power drive inputs without the necessity of coupling/decoupling functions.

These and other objects of the present invention are achieved by a compact operating mechanism for switches and circuit interrupters with improved input drive arrangement and more particularly to a quick-make quick-break operating mechanism for electrical circuit interrupters, i.e. load-interrupter switches and fault interrupters, the drive input arrangement being capable of either power or manual operation without the necessity of any coupling/decoupling or mode selection.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
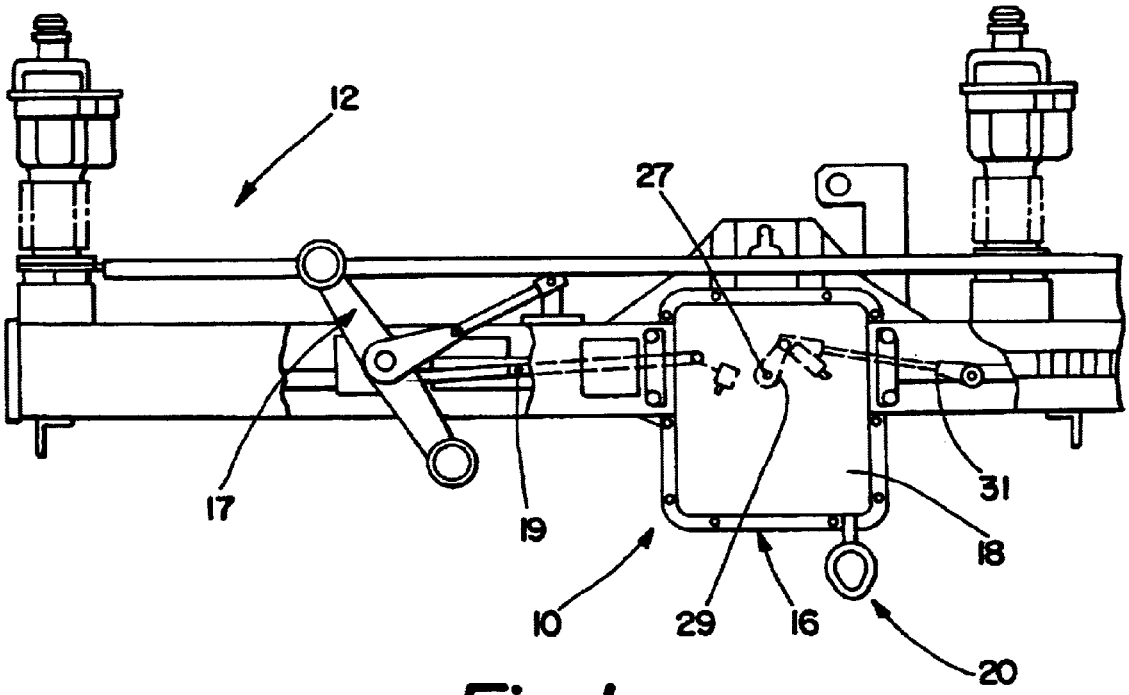
FIG. 1 is a front elevational view of a switch incorporating the operating mechanism in accordance with the principles of the present invention.
Figure 5:
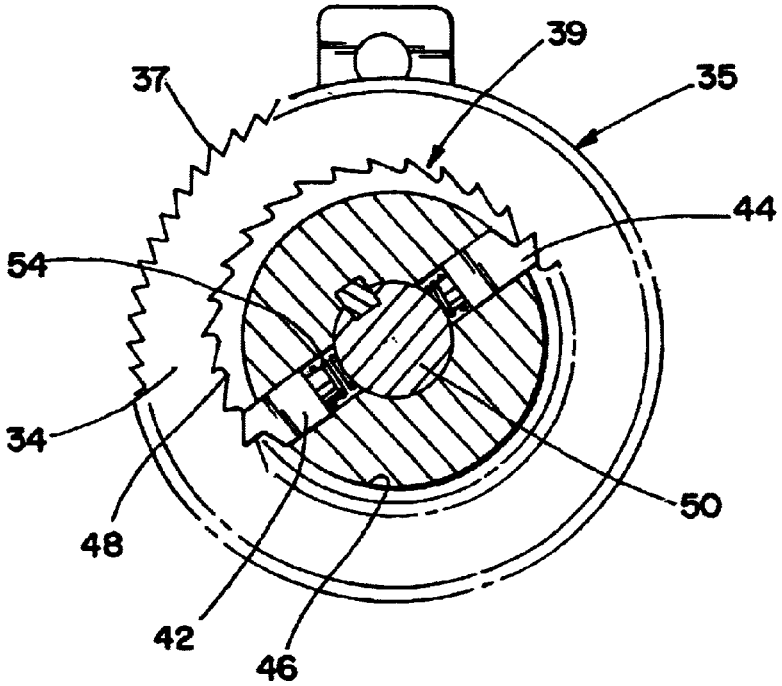
FIG. 5 is an elevational view of the ratchet wheel of the operating mechanism of FIGS. 2–4.
Figure 2:
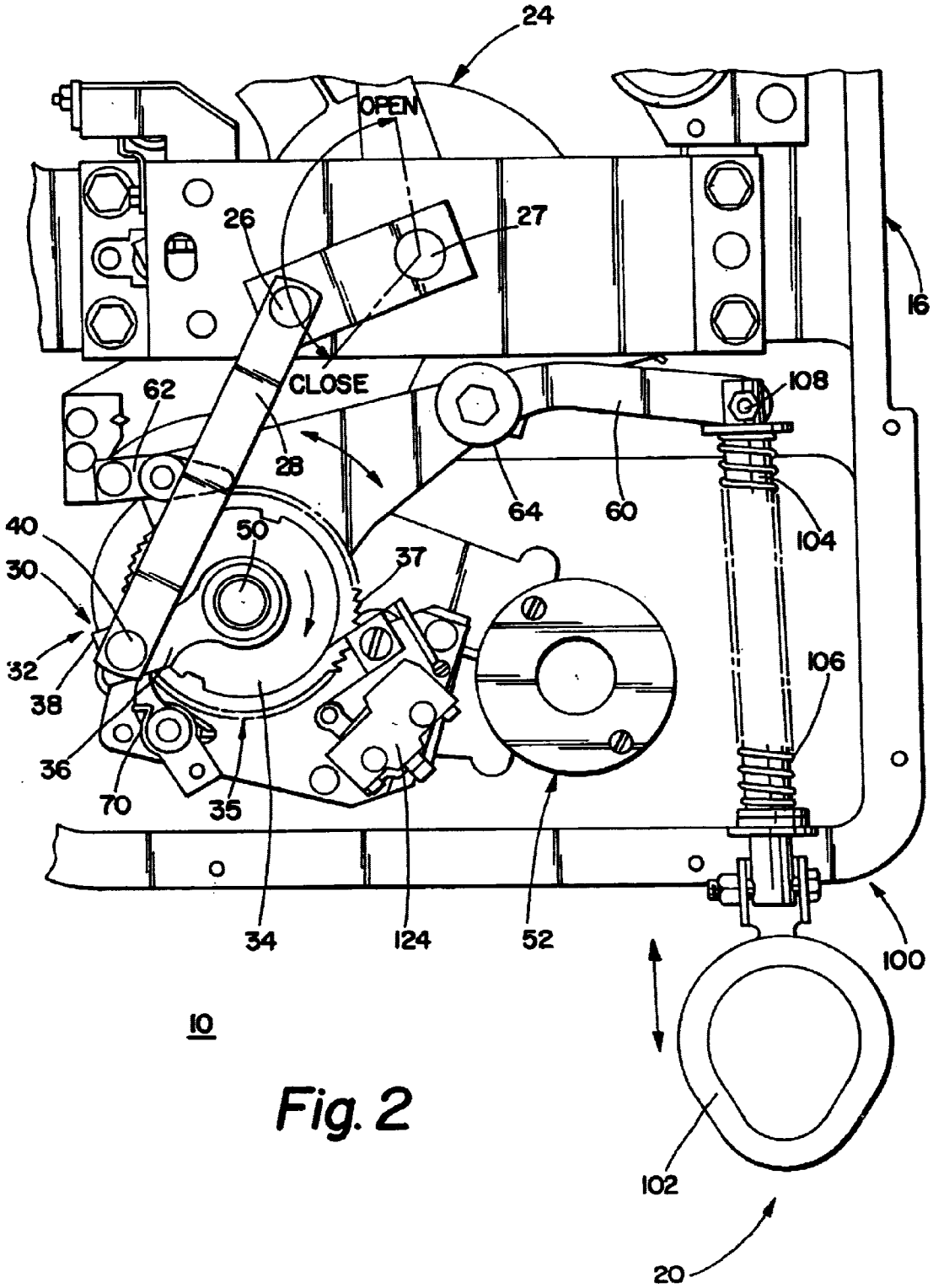
FIGS. 2 and 3 are front elevational views of the operating mechanism of FIG. 1 with parts cut away and removed for clarity.
Figure 3:
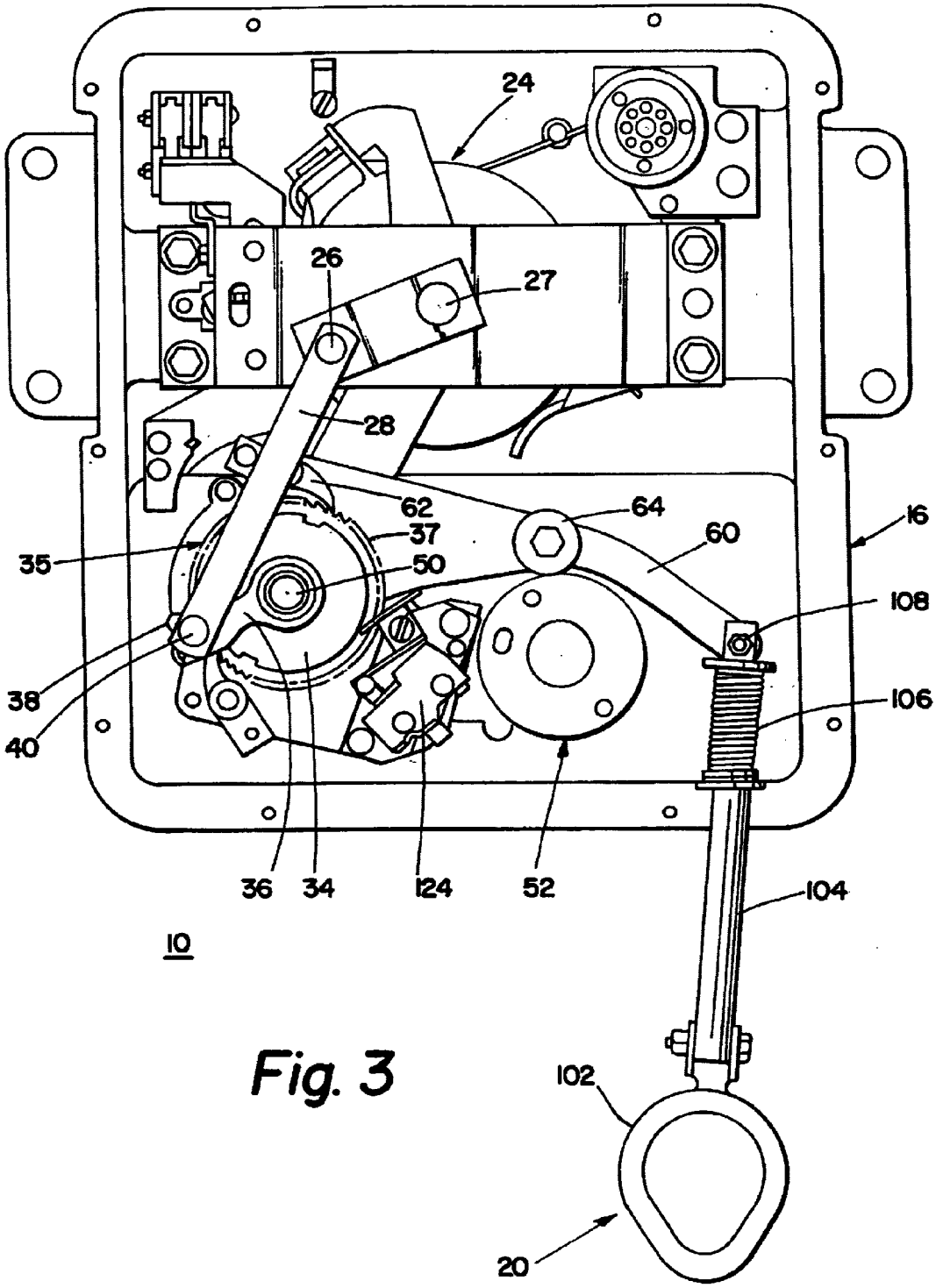

Referring now to FIG. 1, an operating mechanism 10 of the present invention is of the quick-make, quick-break variety and is useful to provide operation of a circuit interrupter, e.g. in a specific application, a group-operated switch 12 as shown in FIG. 1 and in U.S. Pat. Nos. 4,398,072, 5,075,521, 5,091,616 and 5,103,111. In response to power supply connections and control signals, the operating mechanism 10 charges a stored energy mechanism and controls operation thereof between an open position and a closed position. Additionally, the operating mechanism 10 in response to a manual input at 20, operates between open and closed positions. The operating mechanism 10 includes a housing 16 having a removable cover portion 18. Referring now additionally to FIGS. 2–5, the operating mechanism 10 includes a stored-energy mechanism 24, that is rotated via a drive input 26. The operating mechanism 10 via a drive output lever 29 at an output at 27 operates the drive linkage of the switch, e.g. at 31 in FIG. 1 and at 93, 95 of FIG. 5 in U.S. Pat. No. 5,091,616. The stored energy mechanism 24 is of the general type shown in U.S. Pat. Nos. 3,563,102 and 5,075,521. The drive input 26 is driven through a linkage 28 which in turn is connected to be driven at 30 from a drive arrangement 32. The drive arrangement at 32 includes a ratchet wheel 34 that fixedly carries a drive lever 36, a distal end 38 of the drive lever 36 including a pin 40 to provide connection to the linkage 28 at 30. The ratchet wheel 34 is rotatably carried about an output shaft 50 of a motor drive 52. As seen in FIG. 5, the ratchet wheel 34 is driven by a pair of pawls 42, 44 mounted within a hub 46 carried within the ratchet wheel 34 having internal ratchet teeth 48, the hub 46 being keyed to the output shaft 50 and being spring-biased at 54 in an outward direction. For manual operation, a manual drive lever 60 is provided that includes a manual drive pawl 62 pivotally carried by the manual drive lever 60, the manual drive pawl 62 also being characterized as an indexing pawl since multiple strokes of the manual drive lever 60 are required as will be explained in detail hereinafter. The manual drive lever 60 is pivotally mounted at 50 and includes a bumper at 64. The ratchet wheel 34 includes external ratchet teeth 37 arranged about the outer periphery 35 of the ratchet wheel 34. The drive pawls 42, 44 are overdriven during the manual driving of the ratchet wheel 34 via the indexing pawl 62 thereby not backdriving the motor drive 52. Correspondingly, during power operation, the manual drive pawl 62 is overdriven as the ratchet wheel 34 is rotated by the pawls 42, 44. A holding pawl 70 is provided to prevent backdriving of the stored energy mechanism 24 and the ratchet wheel 34.

In normal operation where a power supply is present, the operating mechanism 10 charges the stored energy mechanism 24 to a predetermined pre-charged point prior to an opening or closing operation such that the operating mechanism 10 is always ready for a fast open or close operation upon command. When it is desired to change the state of the operating mechanism 10, e.g. from open to closed or closed to open, the operating mechanism 10 is controlled via the output shaft 50 of the motor drive 52 to drive the stored-energy mechanism 24 beyond the pre-charged state and past the release point of the stored-energy mechanism 24 thereby causing operation. The motor drive 52 immediately recharges the stored-energy mechanism 24 to the pre-charged state for the next operation.

When a power supply is not present, manual operation is available via the manual input at 20 to operate the operating mechanism 10 to change the state of the driven switch. Specifically, a manually operable arrangement 100 including a pull ring 102 that is reciprocated between the positions of FIGS. 2 and 3 a number of times to charge and operate the stored-energy mechanism 24. The manually operable arrangement 100 includes a pull rod 104 biased by a spring 106 with the spring being retained between the cover 18 and the pull rod 104 and being compressed upon each downward stroke of the pull ring 102. Thus, the pull rod is returned under the bias of the spring 106. The pull rod 104 is connected at 108 to pivot the manual drive lever 60.

Figure 4:
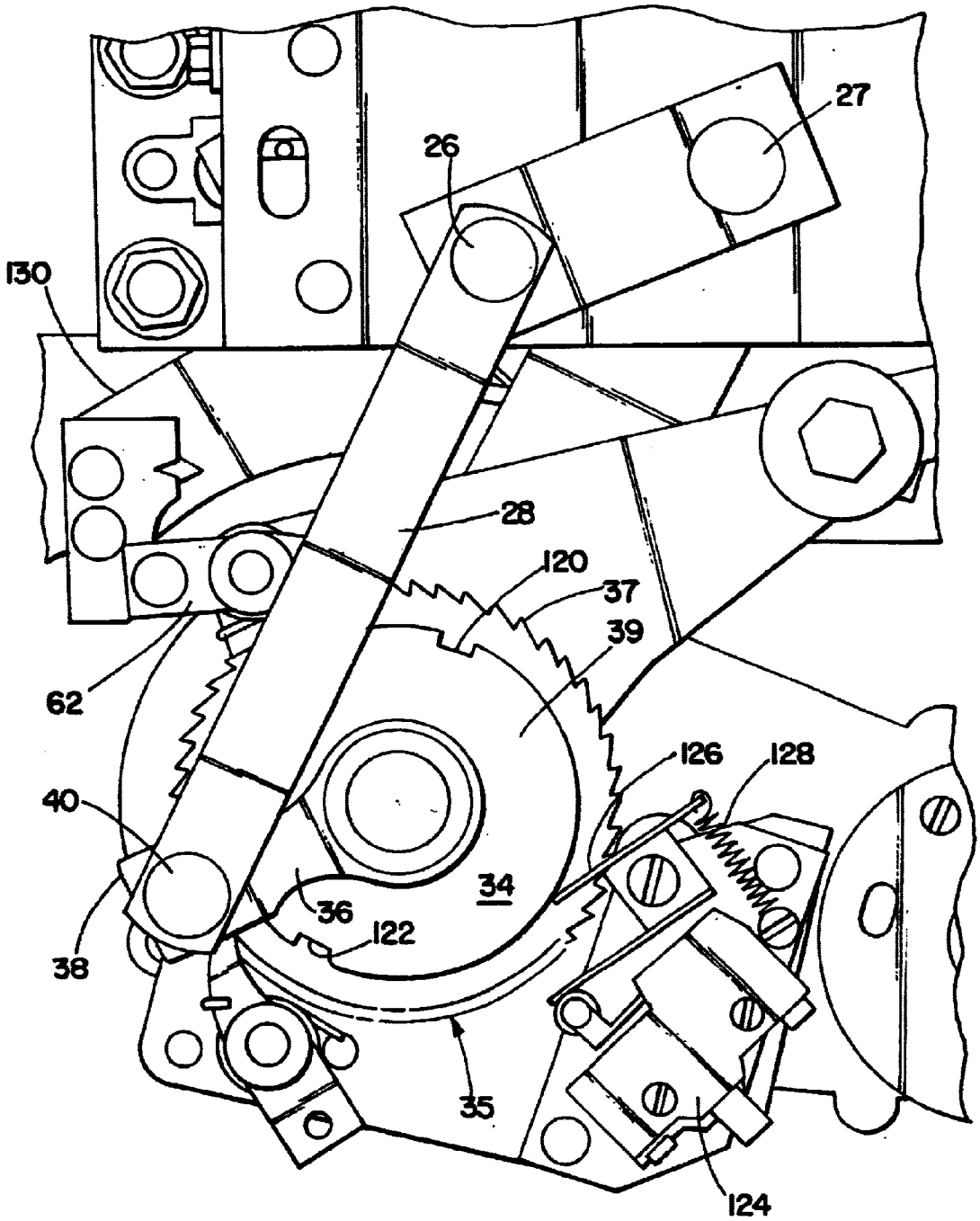
FIG. 4 is an enlarged elevational view of the operating mechanism of FIGS. 2 and 3 and illustrating a different operative position.
Figure 6:
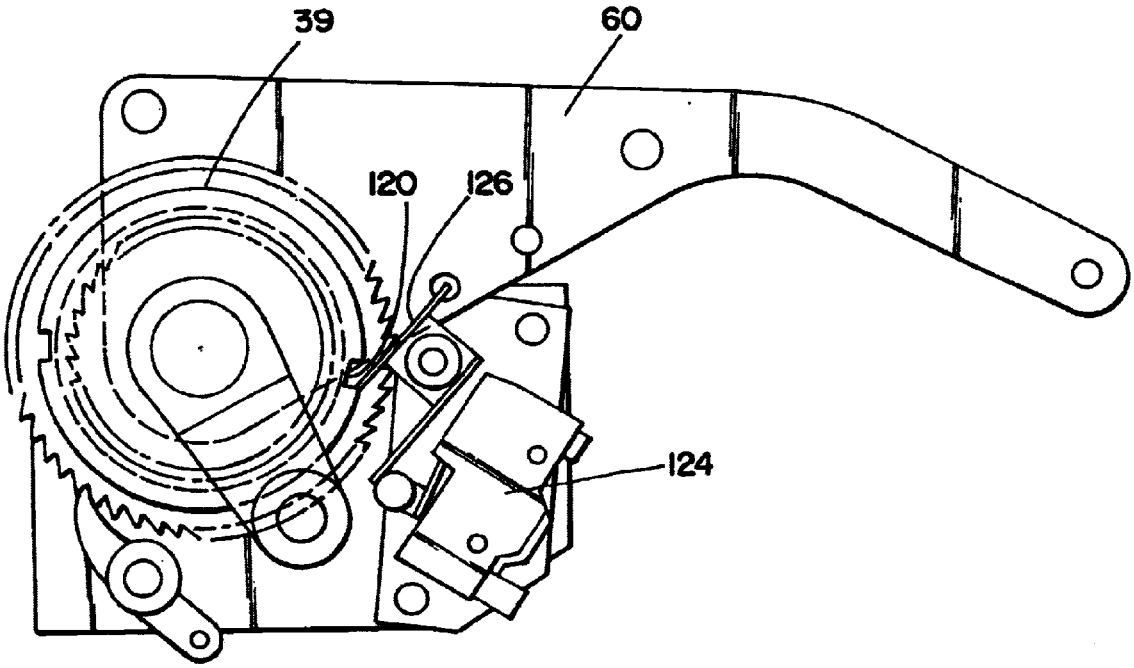
FIGS. 6 and 7 are partial views on an enlarged scale of portions of the operating mechanism of FIGS. 2–4 and illustrating operating control features thereof.
Figure 7:
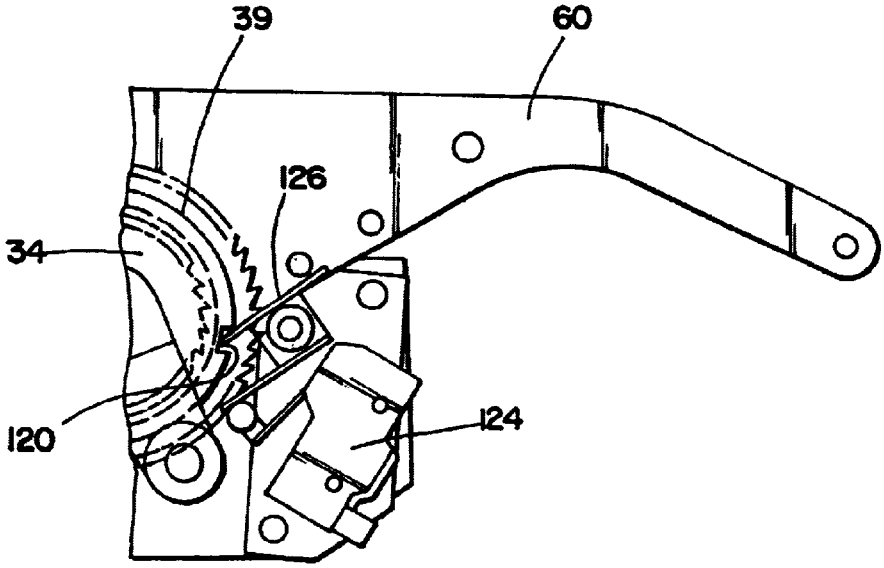

For normal operation where a power supply is present and considering now the arrangement of the operating mechanism 10 to charge the stored energy mechanism 24 to the predetermined pre-charged point and referring specifically now to FIGS. 4, 6 and 7, two control grooves 120, 122 arranged on the periphery of an outside hub 39 of the ratchet wheel 34 cooperate with a limit switch assembly 124. The limit switch 124 is arranged to control power to the motor drive 52. The limit switch assembly 124 includes an intermediate lever 126 that is biased toward the ratchet wheel 34 via a spring 128 and that is positioned to ride on the outside hub 39 of the ratchet wheel 34. When the motor drive 52 has charged the stored energy mechanism 24 to the pre-charged state, the intermediate lever 126 moves into one of the control grooves 120, 122 actuating the limit switch 124 which turns off the motor drive 52 as illustrated in FIG. 7. Thus, the operating mechanism 10 is maintained in the pre-charged position for either opening or closing upon command. The positions illustrated in FIG. 6 depicts the position of the intermediate lever 126 just prior to actuation of the limit switch 124 before reaching the pre-charged position. The expanse and shape of the control grooves 120,122 permit back driving and coasting of the motor drive 52 without deactuating the limit switch 124.

Considering now an interlock feature of the operating mechanism 10 to prevent manual operation when a disconnect switch of the group-operated switch 12 is in an open position, a movable cam surface 130 is provided to lift the manual indexing pawl 62 via contact thereof away from engagement with the ratchet wheel 34 as shown in FIG. 4. Thus, operation of the manual drive lever 60 will neither charge nor trip the operating mechanism 10. Movement of the disconnect operating linkage 17 (FIG. 1) is communicated to the operating mechanism 10 via a connecting member 19.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed is:

1. A drive input arrangement for an operating mechanism that includes a stored energy mechanism and having an output coupled to an electrical switch to operate the switch between open and closed positions and a charging input to charge the stored energy mechanism, the drive input arrangement comprising:

power drive means responsive to an energy source for providing a power-driven output;

a manual drive input;

a drive input for driving the stored energy mechanism of the operating mechanism; and drive coupling means coupled to said power-driven output and said manual drive input for separately and independently coupling movement of said power-driven output and said manual drive input to the charging input without any coupling or decoupling being required, said drive-coupling means comprising a ratchet drive member having internal and external ratchet teeth and ratchet drive means for engaging each of said internal and external ratchet teeth and driving said ratchet drive member.

2. The drive arrangement of claim 1 wherein said power driven output and said manual drive input are coupled to said ratchet drive means.

3. The drive arrangement of claim 2 wherein said ratchet drive means comprises a first drive pawl member operated by said manual drive input and a second drive pawl member operated by said power driven output.

4. The drive arrangement of claim 3 wherein said internal and external ratchet teeth are each arranged circumferentially about said ratchet drive member.

5. The drive arrangement of claim 4 wherein said ratchet drive member is generally circular and said internal and external ratchet teeth are arranged generally concentrically with respect to each other.

6. The drive arrangement of claim 4 wherein said drive-coupling means comprises a holding pawl member selectively engaging aid ratchet drive member to hold said drive-coupling means in a charged state.

7. The drive arrangement of claim 4 wherein said manual drive input comprises a manual operating member pivotally arranged about said ratchet drive member and carrying said first drive pawl so as to be pivotable with respect to said manual operating member.

8. The drive arrangement of claim 4 wherein said first and second drive pawl members are arranged to drive said ratchet member in the same direction.

9. The drive arrangement of claim 1 further comprising interlock means responsive to an interlock input for selectively disengaging said manual drive input from being coupled to the charging input.

10. The drive arrangement of claim 1 wherein said manual drive input comprises a manual operating member operable over a predetermined path and indexing means responsive to multiple operations of said manual operating member over the predetermined path for coupling movement to the charging input.

* * * * *